US006179633B1

(12) United States Patent
Inada

(10) Patent No.: US 6,179,633 B1
(45) Date of Patent: Jan. 30, 2001

(54) AC ADAPTER HAVING ROTATING PLUG

(75) Inventor: Katsutoshi Inada, Fukuoka (JP)

(73) Assignee: Mitsumi Electric Co., Ltd., Tokyo (JP)

( * ) Notice: Under 35 U.S.C. 154(b), the term of this patent shall be extended for 0 days.

(21) Appl. No.: 09/238,432

(22) Filed: Jan. 28, 1999

(30) Foreign Application Priority Data

Feb. 4, 1998 (JP) ..... 10-038078

(51) Int. Cl.[7] ..... H01R 13/44; H01R 13/60
(52) U.S. Cl. ..... 439/131
(58) Field of Search ..... 439/131, 172, 439/166, 171

(56) References Cited

U.S. PATENT DOCUMENTS 4,794,315 * 12/1988 Pederson et al. ..... 320/111
5,967,807 * 10/1999 Wu ..... 439/131

FOREIGN PATENT DOCUMENTS

409266039 * 10/1997 (JP) .

* cited by examiner

*Primary Examiner*—Lincoln Donovan
*Assistant Examiner*—Brian S. Webb
(74) *Attorney, Agent, or Firm*—McGuireWoods LLP

(57) ABSTRACT

An AC adapter, which is to be connected to an AC power source for converting the AC power source into a DC power source, comprises a conductive blade which is to be connected to the AC power source, an insulative plug member an end face of which molds a basal portion of the blade, a casing in which a circuit member for converting the AC power source into the DC power source, the casing rotatably supporting the plug member so the blade as to be allowed in a first state in which the blade is protruded therefrom and in a second state in which the blade is housed therein, a contact member conductive with the blade and protruded from the plug member into an interior of the casing, and a contactor arranged in the interior of the casing so as to contact with the contact portion when the blade is in the first state.

14 Claims, 4 Drawing Sheets

AC ADAPTER HAVING ROTATING PLUG

BACKGROUND OF THE INVENTION

1. Field of the Invention

The present invention relates to an AC adapter in which a rotatable insulative plug laterally protrudes and electrically conductive blades to be connected with the AC power source are partly molded in the plug, and more particularly to an AC adapter in which such blades are pivotally supported so as to be rotatable by 90° between a state where the blades are housed in a part of a casing and another state where the blades protrude from the casing.

2. Description of the Related Art

In some of AC adapters, circuit components for converting an AC power source to a DC power source are housed in a casing. Electrically conductive blades for connected to the AC power source are molded in an electrically insulative plug, and the blades are pivotally supported so as to be rotatable by 90° between a state where the blades are housed in a part of the casing and another state where the blades protrude from the casing. Such an AC adapter can be carried with setting the blades into a housed state, and hence is useful in travel or the like.

FIG. 4 is a front view schematically showing the configuration of a usual AC adapter of this type, in a partially transparent manner. In the figure, 10 denotes an insulative resin casing, 20 denotes a pair of blades which are made of an electrically conductive metal material, and 30 denotes an insulative resin plug which is formed by partly molding the blades 20. In the casing 10, a printed circuit board is housed on which circuit components for converting an AC power source to a DC power source are mounted. The board is not shown in the figure. The plug 30 has a rotation shaft 31 which protrudes from one face of the plug. A bearing structure for supporting the rotation shaft 31 is formed in the casing 10. Since the blades 20 are integrated with the plug 30, the blades can be rotated by 90° about the shaft 31 between a state (indicated by broken lines) where the blades are housed in a part of the casing 10 and another state (indicated by solid lines) where the blades protrude from the casing 10.

FIGS. 3(A), 3(B), and 3(C) are a front view, a side view, and a plan view which show the related structure of the blades 20 and the plug 30, respectively. The plug 30 has an end face 32 from which terminal portions 21 of the blades 20 to be connected with the AC power source protrude, and first and second faces 33 and 34 which are perpendicular to the end face 32 and opposed to each other. The rotation shaft 31 protrudes from the first face 33 in a direction perpendicular to the blades 20. Contact portions of the blades 20 are exposed from the second face 34 without protruding therefrom.

Contactors 40 which are to be respectively elastically contacted with the contact portions 22 of the blades 20 as shown in FIG. 3(B) are disposed on the printed circuit board in the casing 10. The contactors 40 are contacted with the contact portions 22, only under a state where the blades 20 protrude from the casing. FIG. 3(C) shows a state where the blades 20 are housed in the casing 10. Under this state, the contact portions 22 of the blades 20 are located at positions which are rotated by 90° from the respective contactors 40, or separated from the contactors 40.

In the structure shown in FIG. 3, the contact surfaces of the contact portions 22 of the blades 20 are in the same plane as the second face 34 of the plug 30, so that the contactors 40 on the side of the casing are always pressingly contacted with the contact portions 22 of the blades 20 or the second face 34 of the plug 30. When the blades 20 are repeatedly rotated, therefore, the second face 34 of the plug 30 wears and shavings are produced. Since the shavings are electrically insulative, interposition of the shavings between the contactors 40 and the contact portions 22 causes a contact failure. This is a first problem which is to be solved by the invention.

In the structure of FIG. 3, furthermore, a clearance gap 11 inevitably exists between the casing 10 and the plug 30 as shown in FIG. 3(C). Therefore, there is a possibility that a foreign matter enters the interior of the casing 10 through the gap 11. When the foreign matter is electrically conductive, it causes an electric circuit in the casing 10 to be short-circuited. This is a second problem which is to be solved by the invention.

SUMMARY OF THE INVENTION

It is therefore an object of the invention to provide an AC adapter having a structure in which a rotary plug is prevented from wearing and a foreign matter is prevented from entering the interior of a casing from the outside.

In order to achieve the above object, there is provided an AC adapter, which is to be connected to an AC power source for converting the AC power source into a DC power source, comprises: a conductive blade which is to be connected to the AC power source; an insulative plug member an end face of which molds a basal portion of the blade; a casing in which a circuit member for converting the AC power source into the DC power source, the casing rotatably supporting the plug member ao the blade as to be allowed in a first state in which the blade is protruded therefrom and in a second state in which the blade is housed therein; a contact member conductive with the blade and protruded from the plug member into an interior of the casing; and a contactor arranged in the interior of the casing so as to contact with the contact portion when the blade is in the first state.

The plug member includes a first face perpendicular to the end face on which a first shaft is provided and a second face being opposed to the first face on which the contact member and a second shaft, and the plug member is rotatably supported by the casing through the first and second shafts.

The blade transits between the first state and the second state by rotating the plug member in 90 degrees.

DETAILED DESCRIPTION OF THE PREFERRED EMBODIMENTS

Figure 1:
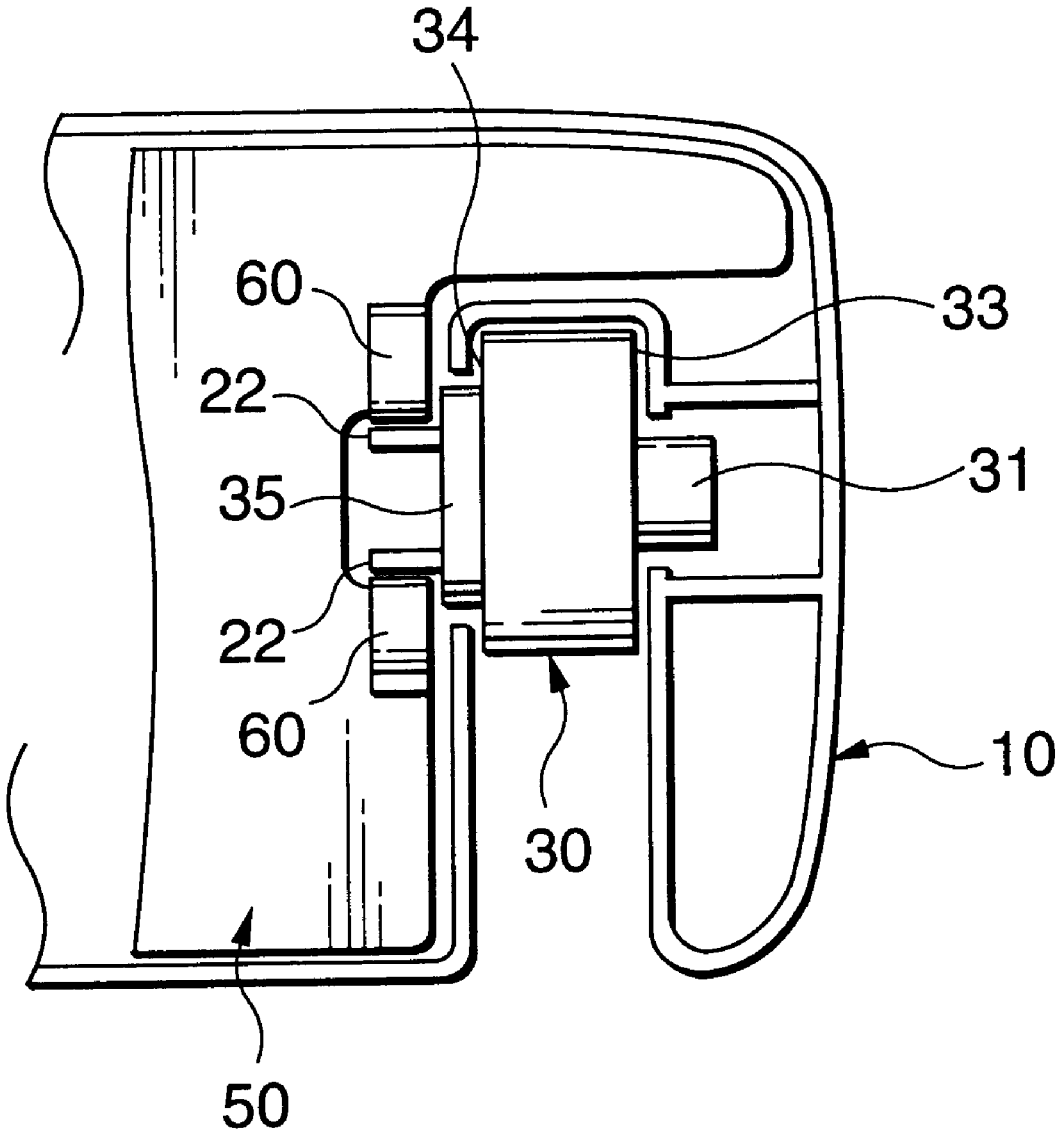
FIG. 1 is a plan view showing an AC adapter of one embodiment according to the present invention.
Figure 2A:
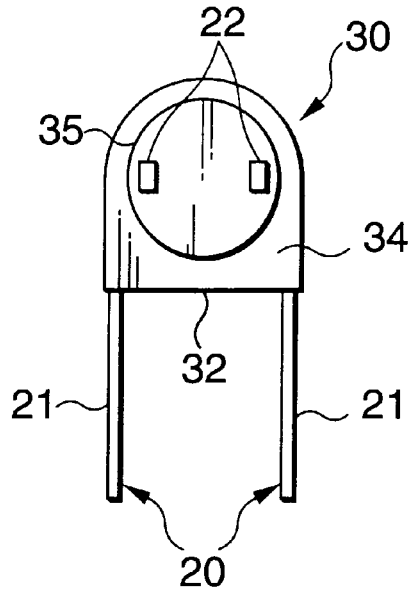
FIGS. 2(A) to 2(C) are views showing the configuration of components of the AC adapter of FIG. 1.
Figure 2B:
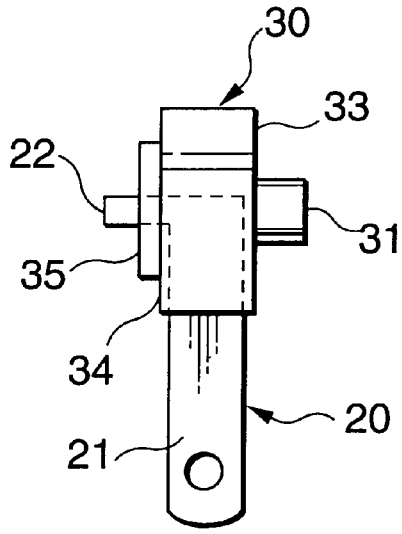
Figure 2C:
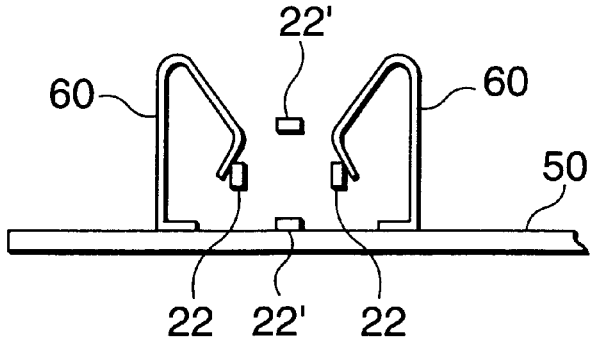

The present invention will be described below in detail with reference to the accompanying drawings. FIG. 1 is a plan view showing an AC adapter of one embodiment according to the present invention, and FIGS. 2(A), 2(B), and 2(C) are front views and a side view which show components of the adapter. In the figures, 10 denotes one of upper or lower casings which cooperate to constitute a casing, and 50 denotes a printed circuit board housed in the casing 10. Various kinds of circuit components which are required for converting an AC power source to a DC power source are mounted on the printed circuit board 50. In the figures, only a pair of contactors 60 which are necessary for the description are shown. FIG. 2(C) is a front view showing the shape of the contactors 60. The contactors 60 are formed by bending metal plates so as to have elasticity in order to be elastically contacted with contact portions 22 of the blades 20, respectively.

In the present invention, the contact portions 22 protrude from a second face 34 of the plug 30 toward the contactors 60. The contactors 60 make contact with the contact portions 22, but do not make any contact with the second face 34 of the plug 30. According to this structure, the plug 30 does not wear, such that insulative shavings are prevented from being produced. FIG. 2(C) shows the contact portions 22, which are contacted with the contactors 60, in the state where the blades 20 protrude from the casing 10, and contact portions 22' in the state where the blades 20 are housed in the casing 10. The contact portions 22' are different in rotation angle from the contact portions 22 by 90° and separated from the contactors 60.

Figure 3:
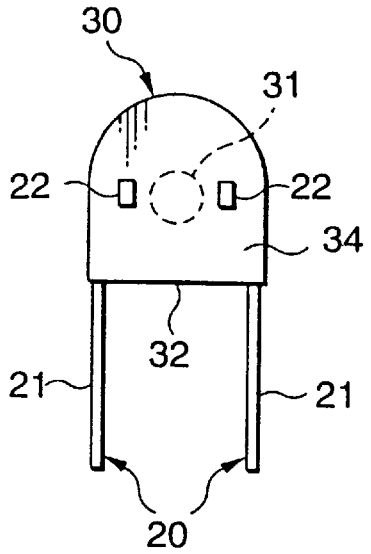
FIG.3 (A) PRIOR ART
FIGS. 3(A) to (C) are views showing the configuration of components of a related AC adapter.
Figure 3:
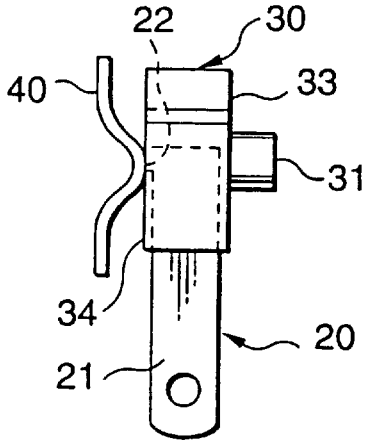
FIG.3 (B) PRIOR ART
Figure 3:
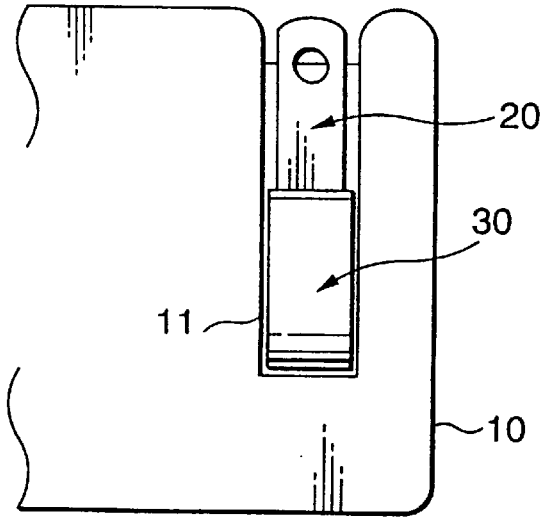
FIG.3 (C) PRIOR ART
Figure 4:
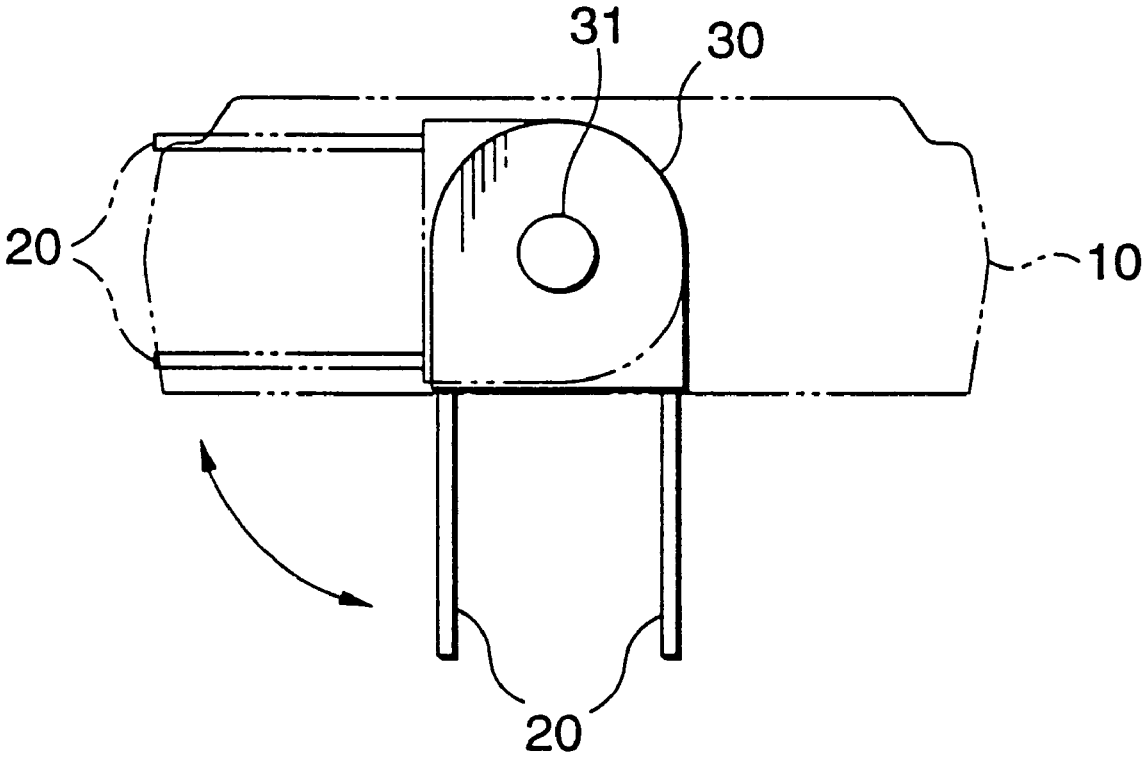
FIG.4 PRIOR ART
FIG. 4 is a front view schematically showing the configuration of a usual AC adapter, in a partially transparent manner.

In the present invention, the basal end portions of the contact portions 22 of the blades 20 are embedded in a second rotation shaft 35 which protrudes from the second face 34 of the plug 30 toward the interior of the casing. The second rotation shaft 35 is larger in diameter than a first rotation shaft 31 which protrudes from a first face 33. The first and second rotation shafts 31 and 35 are coincident in rotation center with each other, but opposite in protrusion direction from each other. The second rotation shaft 35 performs not only the function as a rotation shaft but also the role of covering the clearance gap (11 in FIG. 3(C)) between the casing 10 and the plug 30, in the casing 10. According to this structure, it is possible to prevent a foreign matter from entering the casing 10 to cause a short-circuit failure on the printed circuit board 50.

As has been described heretofore, according to the present invention, it is possible to realize an AC adapter in which, since contact portions of blades protrude from a face of a rotary plug, the plug is prevented from wearing, and, since a part of the face of the plug protrudes into the casing so as to cover a gap between the casing and the plug, a foreign matter is prevented from entering the casing.

What is claimed is:

1. An AC adapter adapted to be connected to an AC power source for converting the AC power source into a DC power source, comprising:

a conductive blade adapted to be connected to the AC power source;

an insulative plug member having an end face of which molds a basal portion of the conductive blade;

a casing in which a circuit member for converting the AC power source into the DC power source is housed, the casing rotatably supporting the insulative plug member of the conductive blade so that the conductive blade can be rotated between a first state in which the conductive blade is protruding from the casing and a second state in which the conductive blade is housed within the casing;

a contact member conductive with and positioned perpendicular to the conductive blade, the contact member protruding from the insulative plug member and extending into an interior of the casing when the conductive blade is in the first state and the second state and during the rotation of the conductive blade between the first state and the second state; and a contactor arranged in the interior of the casing, the contactor contacting the contact member when the conductive blade is in the first state and disengaging from the contact member when the conductive blade is rotated to the second state.

2. The AC adapter as set forth in claim 1, wherein the plug member includes a first face perpendicular to the end face on which a first shaft is provided and a second face opposing the first face on which the contact member and a second shaft is provided, the plug member is rotatably supported by the casing through the first and second shafts.

3. The AC adapter as set forth in claim 2, wherein the blade moves between the first state and the second state by rotating the plug member in 90 degrees.

4. The AC adapter as set forth in claim 1, wherein the contact member is comprised of a first contact part and a second contact part and the conductive blade is comprised of a first conductive blade part and a second conductive blade part, the first contact part is positioned proximate to the circuit member when the first conductive blade part is in the second state.

5. The AC adapter as set forth in claim 4, wherein the first state and the second state are separated by 90 degrees.

6. The AC adapter as set forth in claim 1, wherein the contact member is positioned perpendicular to the end face.

7. The AC adapter as set forth in claim 1, wherein the insulative plug member includes opposing faces, the opposing faces being perpendicular to the end face.

8. The AC adapter as set forth in claim 7, wherein the contact member extends from one of the opposing faces.

9. A rotatable AC adapter adapted for converting an AC power source to a DC power source, comprising:

a casing having an interior portion;

a pair of contactors positioned within the interior portion of the casing;

an insulative plug being rotatably mounted on the casing and having a first end, opposing facing surfaces perpendicular to the first end and a pair of conductive blades extending from the first end, the insulative plug being rotatably mounted about an axis passing through the opposing facing surfaces so that the conductive blades can be rotated between a first state in which the conductive blades protrude from the casing and a second state in which the conductive blades are housed within the casing; and contact members being electrically connected with the conductive blades, the contact members extending from one of the opposing facing surfaces of the insulative plug and contacting the contactors when the conductive blades are rotated in the first position and being positioned between but not contacting the contactors when the conductive blades are rotated into the second state.

10. The AC adapter as set forth in claim 9, wherein the first state and the second state are separated by 90 degrees.

11. The AC adapter as set forth in claim 9, further comprising:

a first rotation shaft positioned on a first surface of the opposing surfaces; and a second rotation shaft positioned on a second surface of the opposing surfaces, wherein the contact members extend from the first rotation shaft.

12. The AC adapter as set forth in claim 11, wherein the second rotation shaft is larger in diameter than the first rotation shaft.

13. The AC adapter as set forth in claim 11, wherein the first rotation shaft and second rotation shaft are coincident in rotation center with one another.

14. The AC adapter as set forth in claim 11, wherein the second rotation shaft covers a clearance gap formed between the casing and the insulative plug.

* * * * *